US009254491B2

(12) United States Patent
Schwelling

(10) Patent No.: US 9,254,491 B2
(45) Date of Patent: Feb. 9, 2016

(54) FILE SHREDDER HAVING A METAL DETECTOR

(76) Inventor: Hermann Schwelling, Salem (DE)

( * ) Notice: Subject to any disclaimer, the term of this patent is extended or adjusted under 35 U.S.C. 154(b) by 790 days.

(21) Appl. No.: 13/132,630

(22) PCT Filed: Oct. 4, 2010

(86) PCT No.: PCT/EP2010/006032

§ 371 (c)(1),
(2), (4) Date: Jun. 3, 2011

(87) PCT Pub. No.: WO2011/042139

PCT Pub. Date: Apr. 14, 2011

(65) Prior Publication Data

US 2012/0001001 A1 Jan. 5, 2012

(30) Foreign Application Priority Data

Oct. 5, 2009 (DE) ..... 20 2009 013 428 U

(51) Int. Cl.
*B02C 18/00* (2006.01)
*B02C 25/00* (2006.01)
*B02C 23/04* (2006.01)

(52) U.S. Cl.
CPC ..... *B02C 18/0007* (2013.01); *B02C 23/04* (2013.01); *B02C 25/00* (2013.01)

(58) Field of Classification Search
CPC ..... B02C 18/16; B02C 18/06; B02C 23/04; B02C 18/0007; B02C 13/31; B02C 25/00
USPC ..... 241/33, 34, 100, 101.2, 236, 300, 25, 241/37.5
See application file for complete search history.

(56) References Cited

U.S. PATENT DOCUMENTS

| | | | | |
|---|---|---|---|---|
| 4,527,473 | A * | 7/1985 | Littleton | 101/220 |
| 4,771,360 | A * | 9/1988 | Ayash | 361/221 |
| 5,318,229 | A * | 6/1994 | Brown | 241/34 |
| 5,400,978 | A * | 3/1995 | Strohmeyer | 241/166 |
| 5,462,126 | A * | 10/1995 | Wallace | 173/53 |
| 5,954,280 | A * | 9/1999 | Kroger et al. | 241/166 |
| 6,672,902 | B2 * | 1/2004 | Skinner et al. | 439/607.01 |
| 6,871,815 | B2 * | 3/2005 | Moody et al. | 242/559.2 |
| 6,887,363 | B2 * | 5/2005 | Andreae et al. | 204/623 |
| 6,935,586 | B1 * | 8/2005 | Janssen | 241/101.2 |
| 7,767,070 | B2 * | 8/2010 | Orosz et al. | 204/471 |
| 8,108,067 | B2 * | 1/2012 | Uejo | 700/226 |
| 8,492,661 | B2 * | 7/2013 | Jol | 174/520 |
| 8,684,297 | B2 * | 4/2014 | Moody et al. | 242/560 |
| 2004/0104289 | A1 * | 6/2004 | Schwelling | 241/236 |
| 2006/0081389 | A1 * | 4/2006 | Pille | 174/35 GC |

(Continued)

FOREIGN PATENT DOCUMENTS

DE 3624996 A1 2/1988

*Primary Examiner* — Faye Francis
(74) *Attorney, Agent, or Firm* — Abel Law Group, LLP

(57) ABSTRACT

The invention relates to a file shredder with a device for detecting metallic objects introduced into the paper feed of the file shredder, a cutting unit with rotating cutting tools, a motor for driving the cutting tools and a transmission device for connecting the motor to the rotating cutting tools. According to the invention, substantially all of the metallic components of the cutting unit of the file shredder surrounding the rotating cutting tools, the motor and the transmission device are connected with one another in an electrically conducting manner such that they lie on a common defined electric potential.

14 Claims, 3 Drawing Sheets

(56) References Cited

U.S. PATENT DOCUMENTS

Figure 1:
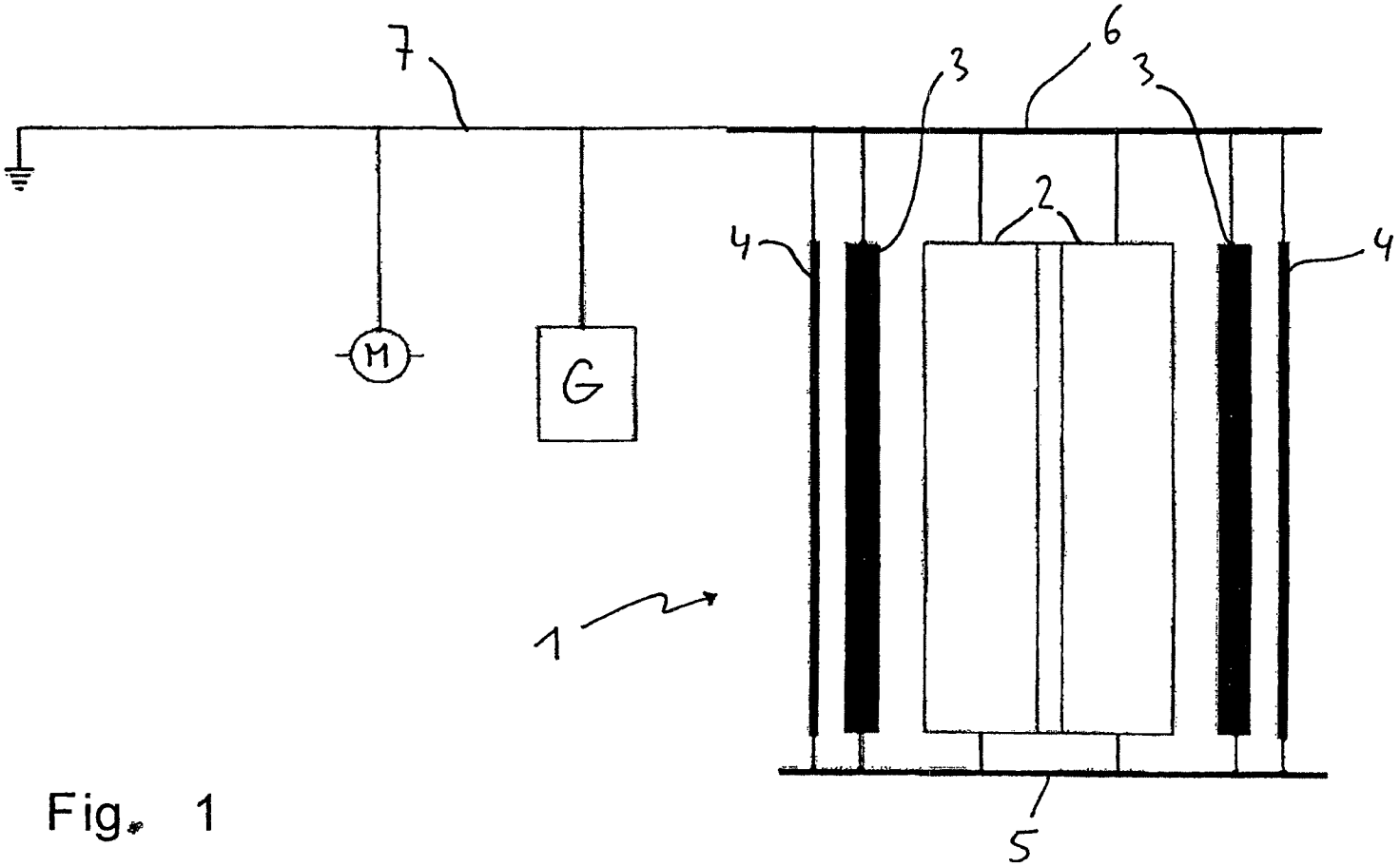

2008/0041207 A1 2/2008 Chen
2008/0048504 A1 2/2008 Chen
2010/0090038 A1* 4/2010 Jensen ..... 241/30
2010/0096484 A1* 4/2010 Jiang ..... 241/285.1
2010/0116916 A1 5/2010 Chen
2011/0272505 A1* 11/2011 Matlin et al. ..... 241/25
2012/0089250 A1* 4/2012 Uejo ..... 700/226

* cited by examiner

FILE SHREDDER HAVING A METAL DETECTOR

I. FIELD OF APPLICATION

The present invention relates to a file shredder and in particular to a file shredder having a metal detector.

II. TECHNICAL BACKGROUND

In order to prevent damage to the cutting unit by metal parts such as e.g., paper clips, staples or the like introduced into the paper feed, some file shredders nowadays have a metal detector. This metal detector usually comprises a sensor device which reacts to metal introduced into the paper guide and switches off the cutting unit and/or the paper feed of the file shredder before the metal parts can come into contact with the cutting elements of the cutting unit.

The mode of operation on which the corresponding metal-detecting sensor device is based is hereby based on the methods generally used for detecting/recognizing metal, such as, for example, pulse measurements based on induction or alternating current measurements.

Due to the small size of the metal object to be detected, and the resulting low signal level, in practice the problem arises with the file shredders according to the prior art that the signal-to-noise ratio is very small, so that a reliable detection of small metal parts is not given.

III. DESCRIPTION OF THE INVENTION a) Technical Object

The object of the invention is therefore to provide a file shredder having a sensor device for metal detection, which reacts reliably even to small metal parts introduced into the paper feed.

b) Solution of the Object

This object is attained through the characterizing features of claim 1. Advantageous embodiments are shown by the dependent claims.

According to the invention, the signal-to-noise ratio occurring in the sensor device is improved in that for noise suppression essentially all of the metal components of the cutting unit, in particular the metal parts of the cutting unit optionally surrounding rotating cutting tools, such as, e.g., baffle plates, spacers or the like, together with the electric motor driving the file shredder and the transmission components mechanically connecting the motor and the cutting tools are laid on a common defined electric potential. This is preferably carried out by a correspondingly electrically conducting connection of these components.

In this manner it can be achieved that the metal components surrounding the rotating cutting tools form a type of Faraday cage which minimizes the noise signals produced due to the relative motion between the rotating cutting tools and the stationary metal detecting sensor.

Advantageously, furthermore the rotating cutting tools themselves are laid on the common defined electric potential jointly with the above-mentioned components. The disrupting influence of the moving cutting tools, usually made of metal, on the sensor signal can thus be further reduced.

Preferably, the common potential is the ground potential.

In particular, the rotating cutting tools and the metallic components of the cutting unit arranged parallel to the cutting tools in the axial direction and optionally surrounding the cutting tools at least in part, such as, e.g., baffle plates or spacers, can be connected to one another at both axial ends of the cutting tools respectively in an electrically conducting manner, so that this produces a ring circuit here.

In order to create an electrical connection between the individual components of the cutting unit, i.e., rotating cutting tools, baffle plates, spacers, etc., for example, on both axial ends of the cutting tools electrically conducting end plates can be provided, on which the individual elements either, e.g., in the case of baffle plates, spacers, etc., are connected in a conductively stationary manner, or, in the case of the rotating cutting tools, are supported in an electrically conducting manner. In addition to metal plates, plates of an electrically conducting composite material, such as, e.g., carbon fiber composites, can also be taken into consideration as electrically conducting end plates.

At the same time, one of these end plates can hereby form a housing wall of the transmission acting between the motor and the cutting tools so that this end plate can also be used for the electrical connection of the corresponding transmission components to the common potential. Preferably, the motor block can also be connected directly to this end plate, so that the electrical connection thereof to the common potential also takes place via the end plate.

An electrically conducting support of the rotating cutting tools in the end plates can be achieved, for example, via sliding contacts or the like. Alternatively or additionally, an electrically conducting sliding contact can also be produced between the rotating cutting tools and the components surrounding them, wherein this can preferably be carried out through the scrapers arranged in the spacers. These scrapers, which are generally used to scrape off paper residue present on the cutting tools, could to this end have carbon brushes, for example, in order to guarantee an electrically conducting sliding contact with the rotating cutting tools.

c) Exemplary Embodiments

Figure 2:
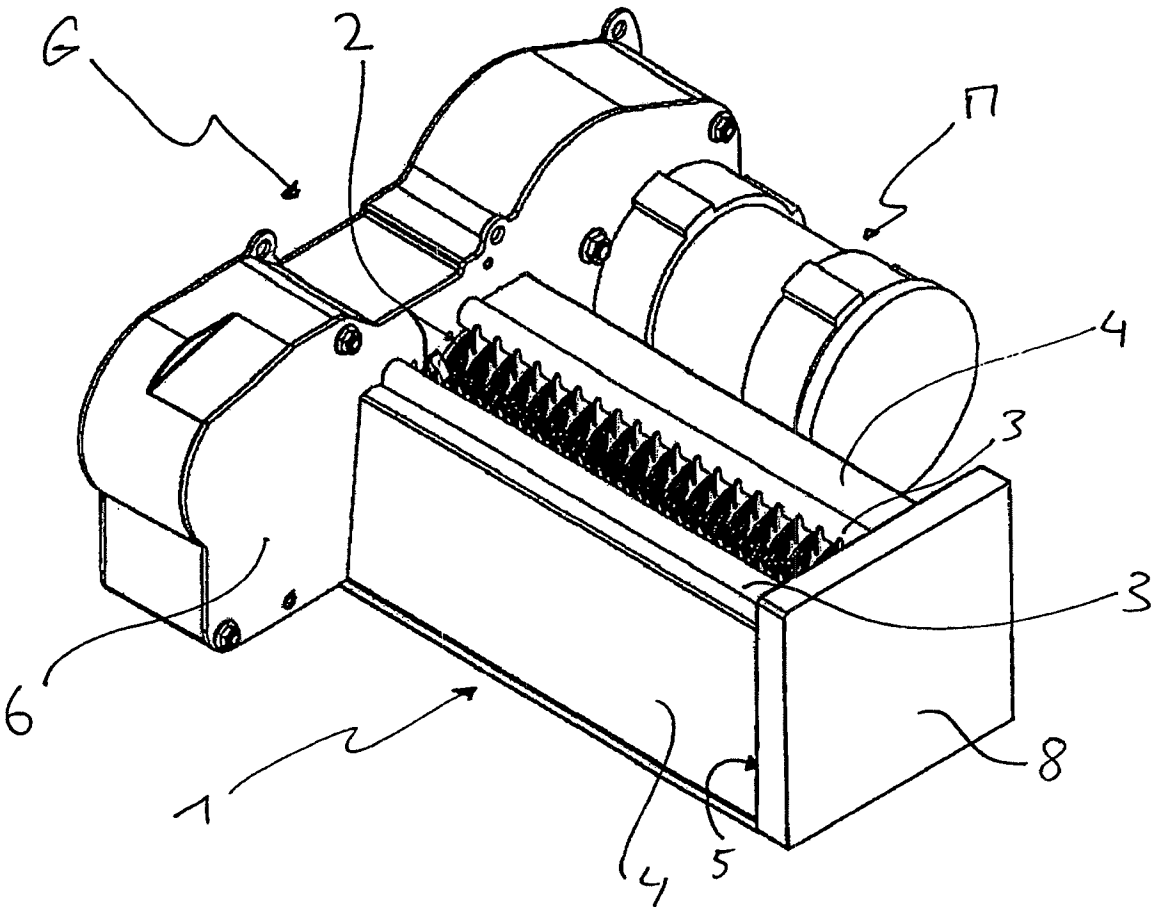

A preferred embodiment of the present invention is described below by way of example based on the figures. They show:

FIG. 1: A diagrammatic circuit diagram of the basic concept of the present invention;

FIG. 2: A perspective view of the cutting unit of a file shredder embodying the present invention and FIG. 3: An exploded drawing of the embodiment from FIG. 2.

FIG. 1 shows a diagrammatic electrical circuit diagram of the basic concept of the present invention. Only the components of a file shredder that are relevant for the present invention are hereby shown, i.e., the cutting unit 1, the motor M and the transmission G mechanically connecting the motor M and the cutting unit 1.

In the example shown, the cutting unit 1 of the file shredder comprises two rotating cutting tools 2. As is usual in file shredders, these are two cutting rollers, the opposite cylindrical surfaces of which are provided with blades between which the material to be destroyed is guided and by which the material is cut into small pieces.

On both sides of the cutting tools 2 respectively a metallic spacer 3 as well as a baffle plate 4 hereby run in parallel arrangement to the cutting tools 2.

At one end of the cutting tools 2, the cutting tools 2, the spacers 3 and the baffle plates 4 are connected to one another in an electrically conducting manner via a first end plate 5. At the other end of the cutting tools 2, the cutting tools 2, the spacers 3 and the baffle plates 4 are connected to one another in an electrically conducting manner via a second end plate 6.

The second end plate 6 is connected to ground via a line 7. Furthermore, the motor M as well as the transmission device G mechanically connecting the cutting unit 1 to the motor M are also connected with the line 7, so that the motor M, the transmission device G as well as the rotating cutting tools 2, the spacers 3 and the baffle plates 4, and thus essentially all of the metallic components of the cutting unit 1, lie on ground potential.

FIG. 2 shows a perspective view of the components of a file shredder that are relevant for the present invention, i.e., the motor M, the transmission device G and the cutting unit 1.

The cutting unit 1 hereby comprises the two cutting tools 2 embodied as counter-rotating rollers, which are partially surrounded by the two spacers 3 and baffle plates 4. The material to be cut by the cutting tools 2 is hereby fed to the cutting tools 2 from above between the spacers 3.

The cutting tools 2, spacers 3 and baffle plates 4 are hereby arranged axially between the housing accommodating the transmission device G and a bearing plate 8, made of plastic in the present example.

Figure 3:
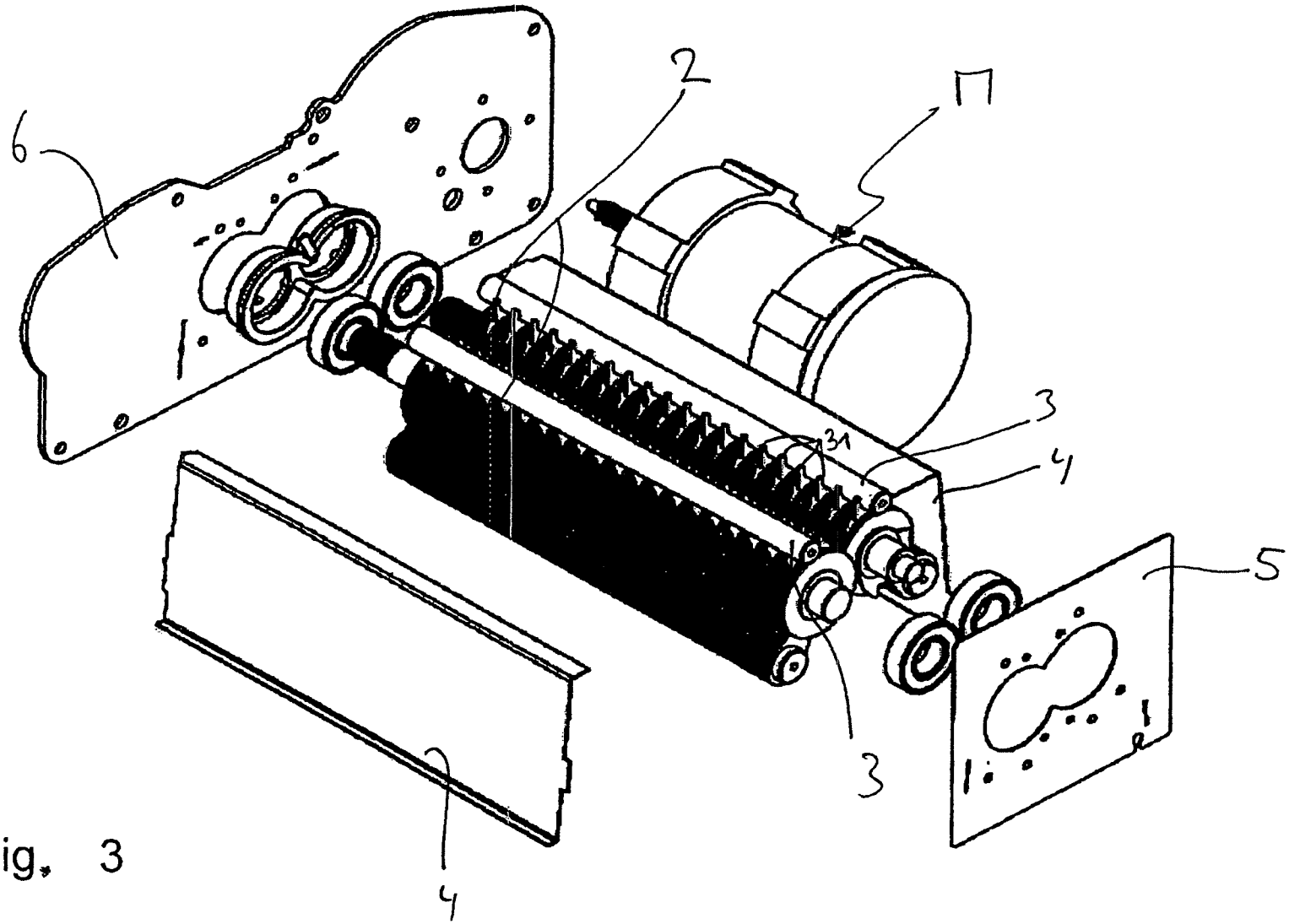

As can be seen from the exploded drawing from FIG. 3, an end plate 5 is arranged between the bearing plate 8 and the cutting tools 2, spacers 3 and baffle plates 4, which end plate is made of an electrically conducting metal and which connects the cutting tools 2, the spacers 3 and the baffle plates 4 to one another in an electrically conducting manner. The bearing plate 8 was not shown hereby for reasons of greater clarity. This also applies to the transmission device G.

On the end lying opposite the bearing plate 8, the cutting tools 2, the spacers 3 and the baffle plates 4 are connected to a second end plate 6 in an electrically conducting manner, which second end plate at the same time forms a housing wall of the housing accommodating the transmission device G. This second end plate 6 is also made of electrically conducting material.

The motor M is also connected to the second end plate 6 in an electrically conducting manner, so that the cutting tools 2, spacers 3, baffle plates 4, motor M and transmission device G lie on a common electric potential. In the embodiment shown, the end plate 6 is connected to ground via a line (not shown), so that the common electric potential is formed by the ground potential.

In the embodiment shown, the spacers 3 each have several recesses 31 distributed across their axial direction, which act as scraper elements and in which during operation of the file shredder the cutting elements of the cutting tools 2 in part engage. In order to improve the electric contact between the rotating cutting tools 2 and the spacers 3 even further, in this case there is a sliding electrical contact between these elements.

LIST OF REFERENCE NUMERALS

1 Cutting unit
2 Cutting tools
3 Spacer
4 Baffle plate
5 First end plate
6 Second end plate
7 Line
8 Bearing plate
G Transmission device
M Motor
31 Recesses in 3

The invention claimed is:

1. A file shredder, wherein the file shredder comprises:
(a) a device for detecting metallic objects introduced into a paper feed of the file shredder,
(b) a cutting unit comprising rotating cutting tools and metallic components surrounding the cutting tools,
(c) a motor for driving the cutting tools of (b), and
(d) a transmission device for connecting the motor (c) to the rotating cutting tools of (b),
and wherein the metallic components surrounding the rotating cutting tools, the motor (c), and the transmission device (d) are connected to one another in an electrically conducting manner such that the metallic components surrounding the rotating cutting tools, the motor (c) and the transmission device (d) lie on a common electric potential.

2. The file shredder of claim 1, wherein further also the rotating cutting tools are connected in an electrically conducting manner to the metallic components surrounding the rotating cutting tools, the motor (c), and the transmission device (d) such that the rotating cutting tools, the metallic components surrounding the cutting tools, the motor (c) and the transmission device (d) lie on the common electric potential.

3. The file shredder of claim 1, wherein the common electric potential is a ground potential.

4. The file shredder of claim 1, wherein in cutting unit (b) the rotating cutting tools and metallic components arranged in axial direction parallel to the cutting tools are connected to one another in an electrically conducting manner at both axial ends of the cutting tools.

5. The file shredder of claim 4, wherein electrically conducting end plates are present at both axial ends of the cutting tools to connect the cutting tools and the metallic components to one another in an electrically conducting manner.

6. The file shredder of claim 5, wherein one of the end plates is formed by a housing wall of the transmission device (d).

7. The file shredder of claim 6, wherein the motor (c) is attached in an electrically conducting manner to the housing wall of the transmission device (d) that forms one of the end plates.

8. A method of improving the signal-to-noise ratio provided by a metal detecting sensor of a file shredder, wherein the method comprises
(a) providing a device for detecting metallic objects introduced into a paper feed of the file shredder,
(b) providing a cutting unit comprising rotating cutting tools and metallic components surrounding the cutting tools,
(c) providing a motor for driving the cutting tools of (b), and
(d) providing a transmission device for connecting the motor (c) to the rotating cutting tools of (b),
and wherein the method further comprises connecting to one another the metallic components surrounding the rotating cutting tools, the motor (c), and the transmission device (d) in an electrically conducting manner such that the metallic components surrounding the rotating cutting tools, the motor (c) and the transmission device (d) lie on a common electric potential.

9. The method of claim 8, wherein further also the rotating cutting tools are connected in an electrically conducting manner to the metallic components surrounding the rotating cutting tools, the motor (c), and the transmission device (d) such that the rotating cutting tools, the metallic components surrounding the cutting tools, the motor (c) and the transmission device (d) lie on the common electric potential.

10. The method of claim 8, wherein the common electric potential is a ground potential.

11. The method of claim 8, wherein the rotating cutting tools and the metallic components of the cutting unit (b) that are arranged in axial direction parallel to the cutting tools are connected to one another in an electrically conducting manner at both axial ends of the cutting tools.

12. The method of claim 11, wherein electrically conducting end plates are arranged at both axial ends of the cutting tools to connect the cutting tools and the metallic components of the cutting unit (b) that are arranged parallel in axial direction to the cutting tools to one another in an electrically conducting manner.

13. The method of claim 12, wherein one of the end plates is formed by a housing wall of the transmission device (d).

14. The method of claim 13, wherein the motor (c) is attached in an electrically conducting manner to the housing wall of the transmission device (d) that forms one of the end plates.

* * * * *